US005337503A

United States Patent [19]

Goby

[11] Patent Number: 5,337,503

[45] Date of Patent: Aug. 16, 1994

[54] MANUALLY LOCKABLE SEAL

[75] Inventor: André Goby, Kappelen, France

[73] Assignee: Stoba AG, Horn, Switzerland

[21] Appl. No.: 998,433

[22] Filed: Dec. 30, 1992

[30] Foreign Application Priority Data

Jan. 10, 1992 [CH] Switzerland ..... 00 069/92-2

[51] Int. Cl.[5] ..... G09F 3/14

[52] U.S. Cl. ..... 40/665; 292/318; 24/30.5 P

[58] Field of Search ..... 40/633, 665, 300, 304; 292/318, 319, 320, 321, 322; 24/16 PB, 30.5 P, 704.1

[56] References Cited

U.S. PATENT DOCUMENTS

| | | | |
|---|---|---|---|
| 2,006,051 | 6/1935 | Keidel | 292/318 X |
| 4,199,882 | 4/1980 | Clayman | 40/633 |
| 4,306,745 | 12/1981 | Wenk | 292/318 |
| 4,424,994 | 1/1984 | Dowden | 292/318 |
| 4,711,002 | 12/1987 | Kreeger | 242/318 X |
| 5,123,686 | 6/1992 | Wenk | 292/321 |

FOREIGN PATENT DOCUMENTS

| | | | |
|---|---|---|---|
| 1424997 | 12/1968 | Fed. Rep. of Germany | 40/304 |
| 2179342 | 11/1973 | France . | |
| 1257556 | 12/1971 | United Kingdom . | |
| 2051942 | 1/1981 | United Kingdom | 40/665 |

*Primary Examiner*—Brian K. Green

*Attorney, Agent, or Firm*—Flynn, Thiel, Boutell & Tanis

[57] ABSTRACT

A closed seal member has a channel extending through it and contains a holder with locking members for the irreversible holding of an end of a flexible band of metal, which end is introduced into the channel. The other end of the band is fastened in the seal member. The flexible band carries a detachable code carrier. Both the seal member and also the code carrier fastened on the band have a code which is identical for both or is a unique code. The code carrier is fastened in such an area of the band that the seal can be closed only after removal of the code carrier.

8 Claims, 3 Drawing Sheets

MANUALLY LOCKABLE SEAL

FIELD OF THE INVENTION

The present invention relates to a manually lockable seal which includes a seal member through which a channel extends, and a holder disposed in this channel with locking members for nonreleasably holding one end of a flexible band of metal after it has been introduced into said channel, the other end of said band being nonreleasably fastened on or in the seal member.

BACKGROUND OF THE INVENTION

Manually lockable seals of this type are known in many variations, for example from Swiss Patent Nos. 481 444, 525 813 and 643 079. They are used to secure locks, where the locking parts in the locking system have openings which, in the locked state of the system, coincide at least approximately, so that the band anchored at one end on or in the seal member can be guided with its other end through the openings. The free end of the band is subsequently guided into the channel of the seal member, where catch members of the band engage the locking members to prevent their withdrawal, so that an opening of the lock sealed in this manner can occur only via destruction of the seal. This security for a lock is desired or demanded in many cases, for example for bag locks, in particular in the case of mail bags, and for the sealing of the loading compartment of vehicles, etc.

These known seals are themselves significantly secured against manipulation in that they can, once closed, no longer be opened without being damaged or altered, and thus permit any manipulation to be recognized. Since, however, we are dealing in the case of such a seal with a pure article of mass production, it is not impossible for malicious persons to obtain open seals of the same type and to exchange an unjustifiably opened seal with a similar new seal in order to cover up the manipulation. Seals permitting this cannot meet high security demands, since with this the purpose of the seal has been avoided. It also does not help that, independently from the seal, documents are often worked out which define the sealed-off goods and permit a check of the goods after the authorized opening of the seal, because these papers can also be easily altered with the copying processes of today.

It is therefore an object of the present invention to improve a seal of the above-mentioned type so that it can be recognized by a clear characteristic as a single piece and therefore, once it has been closed, cannot be exchanged without this being noticed, and which in addition is also essentially protected against other manipulations.

SUMMARY OF THE INVENTION

This purpose is attained with a seal in which the flexible band has a code carrier detachably connected to it, with both the seal member and also the code carrier being provided with a code identical for both or a unique code, and the code carrier is fastened in such an area of the band that the flexible band can be inserted into the seal member only after removal of the code carrier.

Due to the fact that, in the seal of the invention, the seal member carries a unique, nonconfusable code, for example a number and/or a bar code, and a code carrier carrying the identical code is removably fastened on the band which, for closing the seal, must be introduced into the channel of the seal member to engage the locking members, closing of the seal is possible only after removal of the code carrier, and it can with certainty be determined at the place of destination using the detached code carrier, which for example remained with the sender, whether the existing seal is the same seal which had been closed by the sender. With this the transporters, for example a transport enterprise and in particular its driver, become jointly responsible for the security of the sealed goods.

A particularly advantageous design of the seal of the invention is that the flexible band is formed by a continuously wound flexible metal wire, the windings of which form catch members along the entire length of the band, and that the holder disposed in the channel includes two parts which in turn have two spring tongues which extend from oppositely lying sides into the channel and permit insertion of the band during closing of the seal, but engage the band in a clawlike manner during an attempt to pull the band back again. Especially the postal and custom services appreciate this, or require that the band include a tear-resistant material, in particular metal, which cannot be manipulated with heat.

In order to simply design the releasable fastening of the code carrier when using such a metallic band, the code carrier is in a further development of the invention manufactured in one piece with cams of plastic injection molded on the bands, with the connection between the code carrier and the cams being constructed as a breaking point. The cams injection molded on the band are hereby advantageously tapered so that, during an attempt to pull the band back out of the closed seal, they press the spring tongues additionally into the catch members of the flexible wire.

A further feature makes visible an attempt to release the band from the seal member using heat, thus showing the thereby caused damage to the plastic coating.

According to another feature, it is possible to clip the released code carrier to, for example, a document associated with the sealed goods.

A further feature makes opening of the seal member impossible when the seal is closed.

Another feature prevents access to the locking members in the seal member by means of a pointed tool, for example a screwdriver blade or the like.

BRIEF DESCRIPTION OF THE DRAWINGS

Exemplary embodiments of the invention will be discussed in greater detail hereinafter in connection with exemplary embodiments and with reference to the attached drawings, in which.

DETAILED DESCRIPTION

Figure 1:
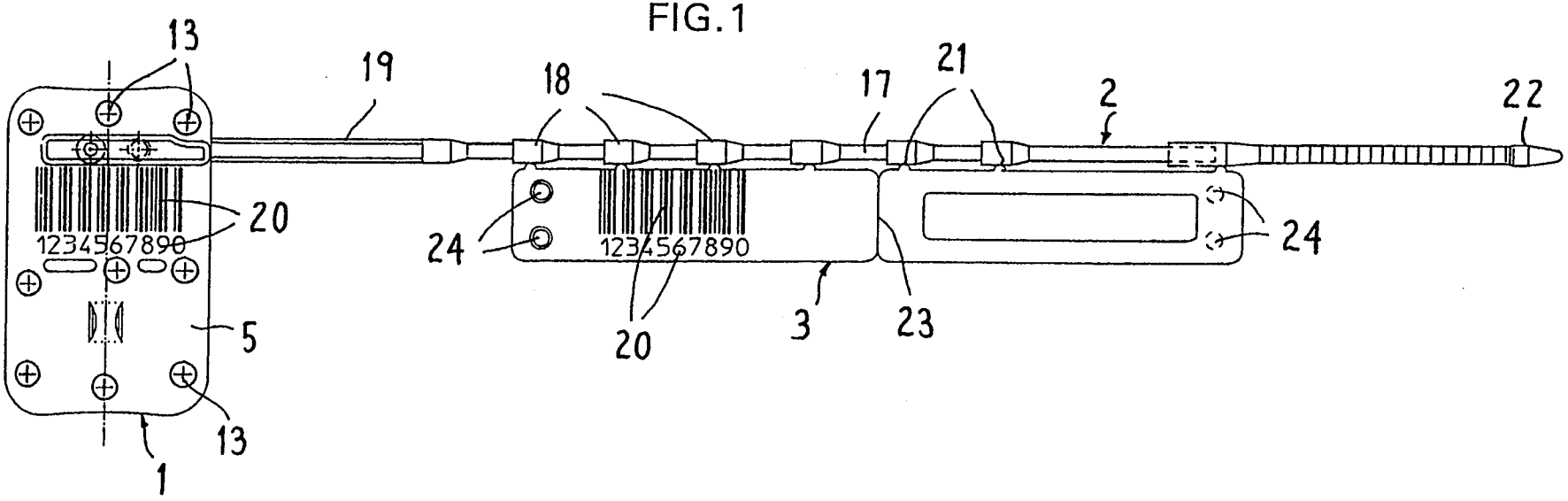
FIG. 1 is a top view of a manually lockable seal of the invention prior to its use.

Referring to FIG. 1, an illustrated seal includes as its main parts a closed seal member 1, a flexible band 2, and a code carrier 3 fastened thereon.

Figure 5:
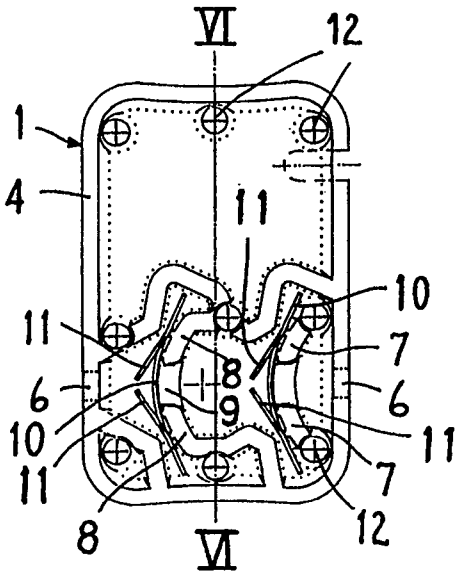
FIG. 5 is a top view of the seal member with the lid removed to show the locking members.
Figure 6:
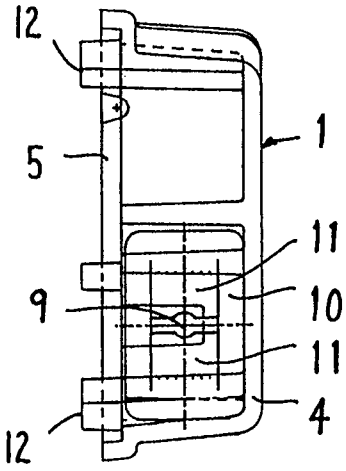
FIG. 6 is a cross-sectional view taken along the line VI—VI in FIG. 5.
Figure 7:
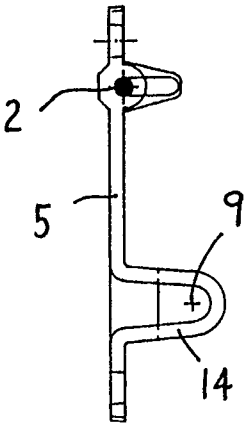
FIG. 7 is a cross-sectional view of the lid of the seal member.

The seal member 1 consists of a container 4 and a lid 5 according to FIGS. 5 to 7. Openings 6 provided in opposite sidewalls of the container 4 and ribs 7 and 8 formed in the container 4 define a channel 9, through which the free end of the band 2 (which free end is bent back to the container 4) can be inserted to close the seal with the seal member 1, which will be discussed in greater detail later on. The ribs 7 and 8 are at the same time a holder and stops for locking members 10 which are two punched parts of spring steel having spring tongues 11 projecting from opposite sides into the channel 9. These spring tongues 11 give way resiliently when the band 2 is placed through the channel from the right to the left in FIG. 5 and thus permit the band 2 to pass through, but during an attempt to pull the band 2 back out they engage catch members or serrations on the band 2 in a clawlike or ratchetlike manner. The illustrated examples show the channel 9 as extending rectilinearly from one opening 6 to the other. A further safety measure against manipulation could be, according to a not-illustrated advantageous embodiment, to permit this channel to be for example arc-shaped, curve-shaped or meaner-shaped instead of rectilinear. In this case, the flexible band 2 could still be placed through the channel 9 in order to close the seal, but it would no longer be possible to reach the spring tongues 11 with a pointed article, for example a screw driver or the like, through the openings 6 in order to try to release their engagement with the band 2 and thus to free the band 2.

Furthermore, wooden pegs 12 are formed in the container 4 to receive rivets 13, by means of which, after the insertion of the locking members 10 during the installation of the seal, the lid 5 which has fitting openings for the rivets 13 can be connected nonreleasably to the container 4 and the seal member 1 can thus be locked. The arrangement is thereby advantageously such that the heads of the rivets 13 are countersunk in the lid 5 so that the act of simply shearing off the rivet heads can be prevented.

In addition, the lid 5 and the container 4 can be welded together in order to create at least one watertight chamber in the seal member 1, which could receive electronic safety devices, for example chips or minitransmitters.

As shown in FIG. 7, the lid also has on its inside a projection 14 with a hole. This projection extends, when the seal member 1 is closed, between the two locking members 10 into the channel 9 so that the band 2 placed through the channel 9 during closing of the seal also extends through the hole in the projection and thus prevents, when the seal is closed, the seal member 1 from being opened by releasing of the lid 5 for the purpose of unauthorized manipulations.

Figure 8:
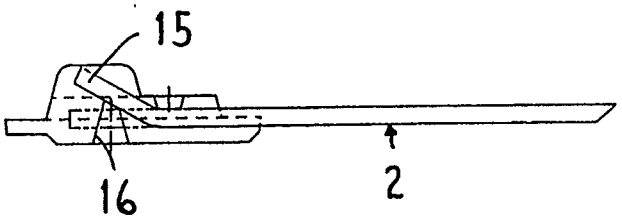
FIG. 8 is a cross-sectional view showing the anchoring of the band in the seal member.

Also, one end of the band 2 is nonreleasably anchored inside of the lid 5 in such a manner that, as shown in FIG. 8, when the lid 5 is placed onto the container 4, the anchored end 15 of the band 2 is bent by a projection 16, which represents a further safety measure against unintended manipulations.

The band 2 is formed by a continuously wound flexible metal wire 17, the windings of which form over the entire length of the band 2 catch members for the locking members 10 in the seal member 1. Cams 18 of plastic are injection molded at spaced intervals on the flexible metal wire 17. These cams 18 help to additionally guide the strand 2 through the channel 9 in the seal member 1. They are tapered and, during an attempt to pull back a strand 2 which has been placed through the locking member 10, press the spring tongues 11 of the locking members 10 more firmly into the flexible wire 17. In order to make it easier to guide the strand 2 into and through the channel 9 of the seal member 1 during closing of the seal, its free end 22 is reinforced by cross-spraying or the like. The flexible metal wire 17 is cross-sprayed with a plastic coating 19 as a further measure to indicate any manipulation in the portion of the band 2 between its exit from the seal member 1 and, in the illustrated example, the first cam 18. This plastic layer 19 will definitely be damaged during an attempt to use heat to release the flexible metal wire 17 from its anchorage in the seal member 1, and thus makes such an unsuccessful manipulation visible.

Figure 2:
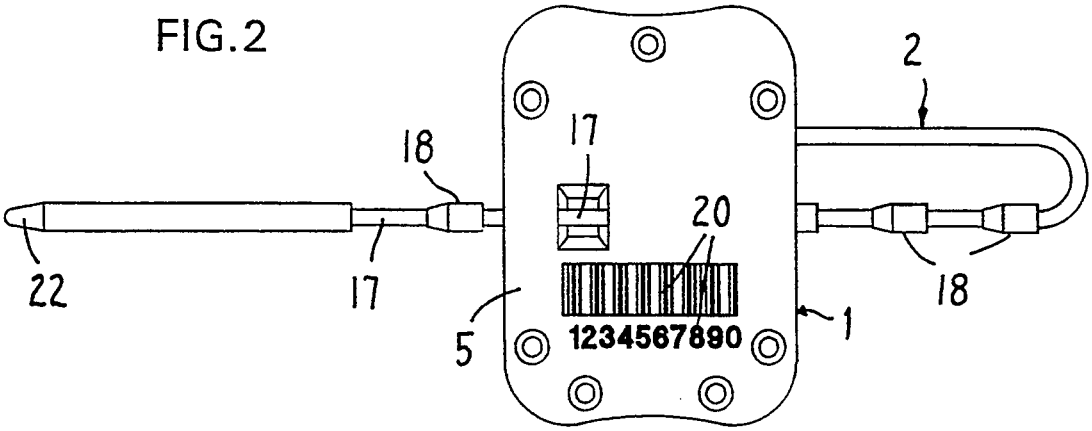
FIG. 2 is a top view of the same seal in a closed state after the code carrier has been removed.
Figure 3:
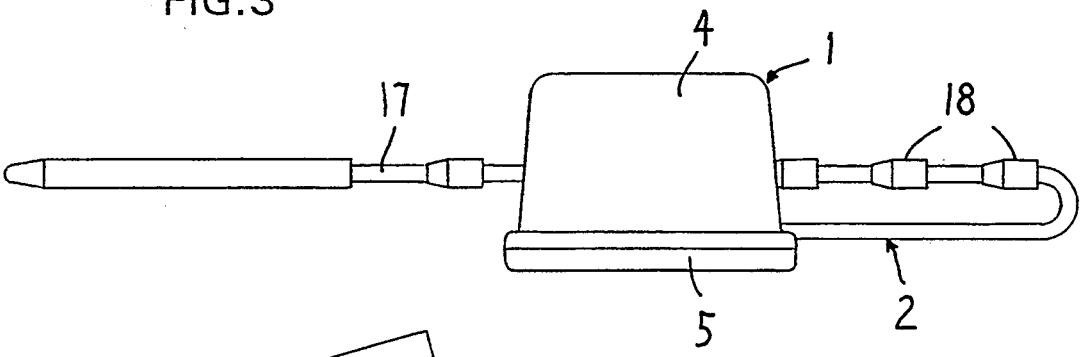
FIG. 3 is a side view of FIG. 2.

The seal member 1, in the present example the outside of the lid 5, has a unique code 20, in this case a number and a bar code which are embossed or imprinted advantageously during the manufacture of this seal part. The identical unique code 20 is also applied to the code carrier 3, which is manufactured in one piece with some of the cams 18 injection molded on the flexible metal wire 17. The connecting points between the code carrier 3 and the cams 18 are thereby constructed as breaking points 21. The code carrier 3 is thus easily removably fastened on the band 2 and, as shown in FIGS. 1 to 3, the code carrier 3 is mounted in such an area of the band 2 that the band 2 can, only after removal of the code carrier 3, be bent as is needed for its closing, namely for the insertion of its free end 22 into the channel 9 in the seal member 1.

It is guaranteed in this manner that a closing of the seal is possible only after removal of the code carrier 3, and it can be determined at the place of destination in the case of a suspected unauthorized manipulation utilizing the separated code carrier, which for example remained with the sender, whether the seal has been manipulated, but also and in particular whether the existing seal is the same as the one which had been closed by the sender. With this the transporter, for example a transport enterprise, and in particular its driver, become jointly responsible for the unchanged condition of the sealed good.

Figure 4:
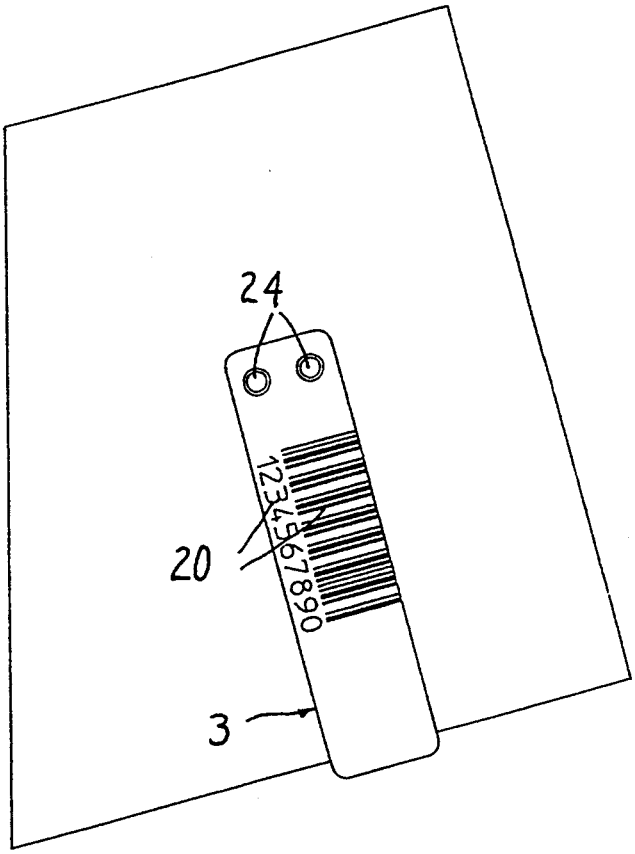
FIG. 4 shows the use of the code carrier broken off from the seal and attached to a paper document.

FIGS. 1 and 4 show that the code carrier 3, which is fastened to and can be broken off from the band 2, is constructed as a foldable medal with a preformed hinge 23, advantageously a film hinge, and spring-lock parts 24. Such a code carrier 3 can, after its release from the band 2, as is shown in FIG. 4, be fastened like a clip by folding it onto a document, which for example contains the identification and route of the transport vehicle with the sealed goods, the date when the sealing was carried out and the name of the person responsible for the transport, and can remain at the place of the sender. If, upon receipt of the sealed goods at the place of destination, fraud or manipulation of the goods is suspected, for example an exchange of the seal, this can immediately be verified by a comparison with the code carrier 3 and the document which remained at the place of the sender.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A manually lockable seal which includes a flexible band made out of metal, a closed seal member through which a channel extends, and a holder disposed in this channel with locking members for nonreleasably holding a first end of said flexible band after it has been introduced into said channel, a second end of said band being nonreleasably fastened on or in the seal member, wherein the flexible band has a code carrier detachably connected to it, with both the seal member and also the code carrier being provided with a unique code which is identical for both, and the code carrier being fastened in such an area of the band that the flexible band can be inserted into the seal member only after removal of the code carrier, wherein the flexible band has a portion formed by a repeatedly wound flexible metal wire, said metal wire having windings which form catch members along an entire length of said portion of the band, and wherein the holder disposed in the channel includes two parts which in turn have two spring tongues extending from oppositely lying sides into the channel, said spring tongues being said locking members and permitting the band to pass through during closing of the seal, but engaging the band in a clawlike manner during an attempt to again pull the band back.

2. A manually lockable seal according to claim 1, wherein the code carrier is manufactured in one piece with cams of plastic injection molded at intervals on the band, the connection between the code carrier and the cams being constructed as a breaking point.

3. A manually lockable seal according to claim 2, wherein the cams injection molded on the band are tapered, define catch members and, during an attempt to pull the band back out of the seal member, press the locking members into the catch members of the band.

4. A manually lockable seal according to claim 2, wherein the band is cross-sprayed with a plastic layer as a manipulation indication over at least a portion of its length located between its exit from the seal member and one of said cams nearest thereto.

5. A manually lockable seal according to claim 1, wherein the code carrier is constructed as a foldable metal piece which, after its release from the band, can be fastened to a document by folding it onto the document.

6. A manually lockable seal according to claim 1, wherein the channel through the seal member is not straight.

7. A manually lockable seal according to claim 1, wherein safety elements are installed water-tight in the seal member.

8. A manually lockable seal which includes a flexible band made out of metal, a closed seal member through which a channel extends, and a holder disposed in this channel with locking members for nonreleasably holding a first end of said flexible band after it has been introduced into said channel, a second end of said band being nonreleasably fastened on or in the seal member, the improvement comprising wherein the flexible band has a code carrier detachably connected to it, with both the seal member and also the code carrier being provided with a unique code which is identical for both, and the code carrier being fastened in such an area of the band that the flexible band can be inserted into the seal member only after removal of the code carrier, wherein the seal member includes a container having the locking members therein and a lid closing off said container and fastened nonreleasably to said container, wherein one end of the band is anchored to an inner side of said lid and the lid has a projection which extends into the channel of the seal member and which has an opening through which a free end of the band can be inserted.

* * * * *